US011603605B2

(12) United States Patent
Smith et al.

(10) Patent No.: US 11,603,605 B2
(45) Date of Patent: Mar. 14, 2023

(54) FUSIBLE BICOMPONENT SPANDEX

(75) Inventors: Steven W. Smith, Waynesboro, VA (US); Hong Liu, Waynesboro, VA (US); Dong Wang, Davis, CA (US); Willem Bakker, Divonne (FR)

(73) Assignee: The LYCRA Company LLC, Wilmington, DE (US)

( * ) Notice: Subject to any disclaimer, the term of this patent is extended or adjusted under 35 U.S.C. 154(b) by 521 days.

(21) Appl. No.: 13/124,437

(22) PCT Filed: Oct. 12, 2009 (Under 37 CFR 1.47)

(86) PCT No.: PCT/US2009/060370

§ 371 (c)(1), (2), (4) Date: Aug. 22, 2011

(87) PCT Pub. No.: WO2010/104531

PCT Pub. Date: Sep. 16, 2010

(65) Prior Publication Data

US 2012/0034834 A1 Feb. 9, 2012

Related U.S. Application Data

(60) Provisional application No. 61/106,288, filed on Oct. 17, 2008, provisional application No. 61/159,311, filed on Mar. 11, 2009.

(51) Int. Cl.
*D04B 1/18* (2006.01)
*D01D 5/32* (2006.01)
(Continued)

(52) U.S. Cl.
CPC ..... *D01F 6/70* (2013.01); *D01F 1/10* (2013.01); *D01F 8/16* (2013.01); *D02G 3/326* (2013.01);
(Continued)

(58) Field of Classification Search
USPC ..... 428/373
See application file for complete search history.

(56) References Cited

U.S. PATENT DOCUMENTS 5,162,074 A 11/1992 Hills
5,256,050 A 10/1993 Davies
(Continued)

FOREIGN PATENT DOCUMENTS

JP 2005-330617 12/2005
JP 2005330617 A * 12/2005
(Continued)

OTHER PUBLICATIONS

Machine translation of JP 2005330617 A. Dec. 2005.*
Full English translation of JP 2005330617 A (Year: 2005).*

*Primary Examiner* — Jennifer A Boyd
*Assistant Examiner* — Ricardo E Lopez

(57) ABSTRACT

Included are multiple component elastic fibers prepared by a solution-spinning process such as dry spinning or wet spinner of spandex fibers including polyurethaneurea and polyurethane compositions. These fibers have a cross-section including at least two separate regions with definable boundaries wherein at least one region defined by the boundaries of the cross-section includes a polyurethaneurea or polyurethane composition. One region of the fiber includes a fusibility improvement additive to enhance adhesion to itself or to a substrate.

18 Claims, 6 Drawing Sheets

(51) Int. Cl.

| | |
|---|---|
| ***C08L 75/04*** | (2006.01) |
| ***D01F 6/70*** | (2006.01) |
| ***D02G 3/32*** | (2006.01) |
| ***D01F 1/10*** | (2006.01) |
| ***D01F 8/16*** | (2006.01) |
| ***D03D 15/56*** | (2021.01) |

(52) U.S. Cl.
CPC ..... *D03D 15/56* (2021.01); *D10B 2401/041* (2013.01); *Y10T 428/2929* (2015.01); *Y10T 442/3024* (2015.04); *Y10T 442/413* (2015.04); *Y10T 442/602* (2015.04)

(56) References Cited

U.S. PATENT DOCUMENTS

| | | | | |
|---|---|---|---|---|
| 6,225,435 | B1 * | 5/2001 | Ito | C08G 18/10 524/873 |
| 6,248,273 | B1 | 6/2001 | Benin et al. | |
| 6,867,260 | B2 | 3/2005 | Datta et al. | |
| 6,946,539 | B2 * | 9/2005 | Sunkara | 528/76 |
| 2001/0039790 | A1 * | 11/2001 | Umezawa et al. | 57/200 |
| 2004/0214498 | A1 * | 10/2004 | Webb et al. | 442/329 |
| 2006/0030229 | A1 | 2/2006 | Fukuoka et al. | |
| 2008/0032580 | A1 | 2/2008 | Fukuoka et al. | |
| 2009/0269582 | A1 | 10/2009 | Hiraishi et al. | |
| 2009/0286441 | A1 * | 11/2009 | Yamamoto et al. | 442/184 |

FOREIGN PATENT DOCUMENTS

| | | | |
|---|---|---|---|
| JP | WO2008004549 | * | 1/2008 |
| KR | 1994-0005924 | | 6/1994 |
| WO | 03/008681 | | 1/2003 |

* cited by examiner

FUSIBLE BICOMPONENT SPANDEX

BACKGROUND OF THE INVENTION

1. Field of the Invention

Included are multiple component elastic fibers prepared by a solution-spinning process such as spandex spinning including polyurethaneurea and polyurethane compositions that have a cross-section including at least two separate regions with definable boundaries wherein at least one region defined by the boundaries of the cross-section includes a polyurethaneurea or polyurethane composition. One region of the fiber includes a fusibility improvement additive to enhance adhesion to itself or to a substrate.

2. Description of the Related Art

Polyurethane or polyurethane-urea (PU or PUU) elastomeric yarns can offer high stretch, good recovery from extension and good fit to the articles made from them, such as weft knit, warp knit, woven fabrics, nonwovens and other textiles. However, for articles containing PU or PUU elastomeric yarns, repeatedly stretching, scratching or cutting often cause problems of laddering, running and curling. These problems include a ladder-like crack and a gap may be generated, elastic yarns may slip out, grin, fray at cut edges and fabric curls may result, which damages the uniformity and appearance of articles. During cutting and sewing process, the phenomenon that PU or PUU elastomeric yarns pull away from seams under repeated extension easily takes place and leads to the loss in stretch of fabrics, which is so called "slip in" or seam slippage. Although such effects happen to elastomeric yarns except PU or PUU yarns, they are especially significant to PU or PUU elastomeric yarns due to their high stretch ability. Moreover, for some articles high steam or heat set efficiency is desired, especially hosiery applications.

Considerable efforts have been dedicated to develop thermal fusible and steam-settable PU or PUU elastomeric yarns. U.S. Patent Application Publication Nos. 2006/0030229A1 and 2008/0032580A1 discloses a type of highly fusible polyurethane elastic filament by melt spinning a polymer synthesized by reacting an isocyanate-terminated prepolymer prepared by the reaction of a polyol and a diisocyanate with a hydroxyl-terminated prepolymer prepared by the reaction of a polyol, a diisocyanate and a low-molecular-weight diol. This fusible PU filament has a melting point of 180° C. or below. Dry heat treatment at 150° C. for 45 seconds at 100% extension could make this PU filament fuse to each other or to other elastic or non-elastic filaments at crossover points. However, the low melting point of the PU filament yields unsatisfactory thermal resistance to creep under normal consumer applications which leads to garment bagging.

Improved spandex yarns are needed which will provide fusibility, steam-set capability during garment manufacturing, and superior stretch resilience to overcome one or more of the deficiencies of currently available fibers.

SUMMARY OF THE INVENTION

The present invention relates to products and process for production of multicomponent spandex fibers with enhanced functionality. Included is solvent spun polyurethane or polyurethaneurea which offer greater stretch/recovery performance and thermal resilience which may be prepared by a bicomponent spinning process, include superior fusibility additives, and result in a fusible yarn suitable for fusing applications such as prevention of laddering, slippage of yarn, and enhancing adhesion.

In some embodiments are elastic, multiple component, solution-spun fibers including a cross-section, wherein at least a first region of said cross-section includes an elastomeric polyurethane, or a polyurethaneurea, or a mixture thereof; and including a second region including an elastomeric polyurethane, or a polyurethaneurea, or a mixture thereof and at least one fusibility improvement additive.

The fibers may have one or more filaments, such as a single monofilament, duo (two filament), three filament, etc. Where a fiber has more than one filament, each filament can include a multiple component cross-section with two or more regions.

In another embodiment is a fabric including an elastic, multiple component, solution-spun fiber including a cross-section, wherein at least a first region of the cross-section comprises at least one elastomeric polyurethane, a polyurethaneurea composition, or mixtures thereof; and including a second region including at least one elastomeric polyurethane, a polyurethaneurea composition, or mixtures thereof and at least one fusibility improvement additive.

Also included is a process for preparing a fusible, elastic, multiple component, solution-spun fiber including:

(a) providing first and second polymer solutions;

(b) combining the solutions through distribution plates and orifices to form filaments having a cross-section;

(c) extruding the filaments through a common capillary; and (d) removing solvent from the filaments;

wherein the cross-section includes a boundary between the polymer solutions;

wherein each of the first and second polymer solutions independently includes an elastomeric polyurethane, a polyurethaneurea, or mixtures thereof; and wherein the second polymer solutions includes a fusibility improvement additive;

wherein the fusible, elastic, multiple component, solution-spun fiber includes a multiple region cross-section with the first polymer solution corresponding to a first region of the cross-section and the second polymer solution corresponding to a second region of the cross-section.

In a further embodiment is a fiber including an elastic, multiple component, solution-spun fiber including a cross-section, wherein at least a first region of the cross-section comprises an elastomeric polyurethane, or a polyurethaneurea, or a mixture thereof; and including a second region comprising an elastomeric polyurethane, or a polyurethaneurea, or a mixture thereof and at least one fusibility improvement additive comprising at least one low temperature melting polyurethane having a melting point from about 100° C. to about 180° C.; and wherein the first region comprises an elastomeric polyurethane having a high melting point from about 190° C. to about 250° C.

The scan was conducted at 10° C./min from −100° C. to 350° C.

Figure 6:
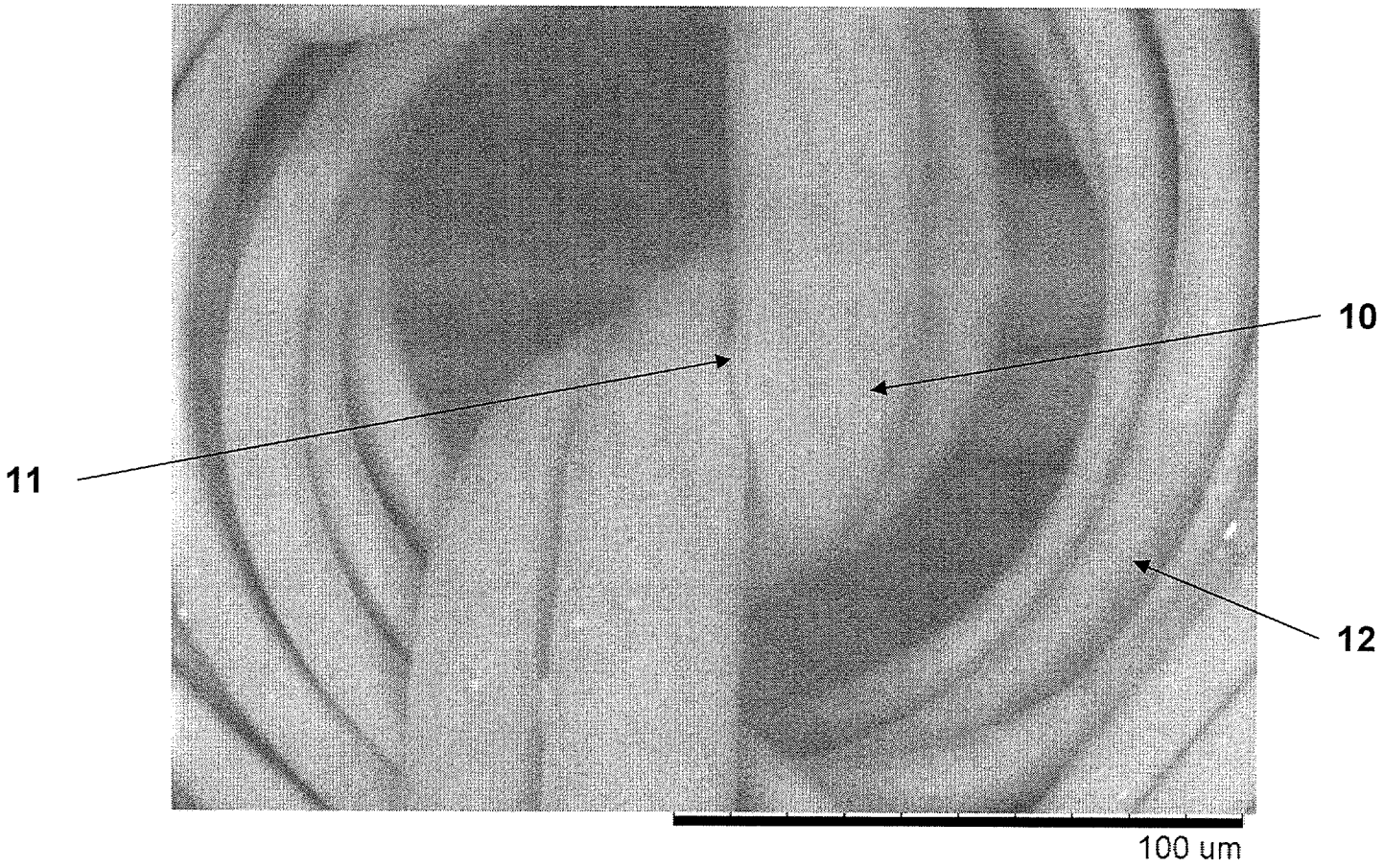

FIG. 6 is an SEM micrograph of a fused yarn of some embodiments.

DETAILED DESCRIPTION OF THE INVENTION

Definitions

The term "multiple component fiber" as used herein means a fiber having at least two separate and distinct regions of different compositions with a discernable boundary, i.e., two or more regions of different compositions that are continuous along the fiber length. This is in contrast to polyurethane or polyurethaneurea blends wherein more than one composition is combined to form a fiber without distinct and continuous boundaries along the length of the fiber. The terms "multiple component fiber" and "multicomponent fiber" are synonymous and are used interchangeably herein.

The term "compositionally different" is defined as two or more compositions including different polymers, copolymers or blends or two or more compositions having one or more different additives, where the polymer included in the compositions may be the same or different. Two compared compositions are also "compositionally different" where they include different polymers and different additives.

The terms "boundary," "boundaries," and "boundary region" are used to describe the point of contact between different regions of the multicomponent fiber cross-section. This point of contact is "well-defined" where there is minimal or no overlap between the compositions of the two regions. Where overlap does exist between two regions, the boundary region will include a blend of the two regions. This blended region may be a separate homogenously blended section with separate boundaries between the blended boundary region and each of the other two regions. Alternatively, the boundary region may include a gradient of higher concentration of the composition of the first region adjacent to the first region to a higher concentration of the composition of the second region adjacent to the second region.

As used herein, "solvent" refers to an organic solvent such as dimethylacetamide (DMAC), dimethylformamide (DMF) and N-methylpyrrolidone.

The term "solution-spinning" as used herein includes the preparation of a fiber from a solution which can be either a wet-spun or dry-spun process, both of which are common techniques for fiber production.

Low-melt polyurethane (PU) compositions ($T_m$<180 C) which provide good steam-set capability and excellent adhesion properties typically yield poor creep resistance, low-strength, and inferior stretch resilience. Furthermore, such low-melt PU compositions are poorly suited to fiber-forming processes and high temperature textile processing demands. The present invention combines the superior stretch and recovery based on solution-spun polyurethane/polyurethaneurea compositions with low-melt adhesive formulations in a multiple component fiber structure, such as a bicomponent fiber structure.

The properties of polyurethane block copolymers depend on phase separation of the urethane and polyol segments, such that the hard urethane domains serve as crosslinks in the soft-segment matrix. The urethane domain is controlled by both content and quality of the selected chain extender. Commercially important diol chain extenders include, without limitation, ethylene glycol, 1,3-propanediol (PDO), 1,4-butanediol (1,4-BDO or BDO), and 1,6-hexanediol (HDO). All of these diol chain extenders form polyurethanes that phase separate well and form well defined hard segment domains and are all suitable for thermoplastic polyurethanes with the exception of ethylene glycol. Since the derived urethane undergoes unfavorable degradation at high hard-segment levels. Table 1 lists typical hard-segment melting ranges for the polyurethanes derived from some common chain extenders. Processing temperatures above 200° C. are unfavorable for common TPU compositions due to thermal degradation during processing and concomitant loss of properties. Additionally, PU derived from high hard-segment melting compositions traditionally yield improved elasticity and thermal resilience and are more desirable for textile processing. Such polyurethane fibers with high hard-segment melting point can only be produced from traditional solution spinning processes to yield superior stretch/recovery properties.

TABLE 1

DSC Assignments for Hard-Segment Polymorphic Structures

| Chain extender | Endotherm (° C.) |
|---|---|
| 1,6-Hexanediol (HDO) | 180-190 |
| 1,4-Butanediol (BDO) | 205-215 |
| 1,3-Propanediol (PDO) | 210-225 |
| Ethylene glycol (EDO) | 245-260 |

A variety of different polyurethane or polyurethaneurea compositions are useful with the present invention in either or both of the first and second regions. Additional regions may also be included. Useful polyurethane/polyurethaneurea compositions are described in detail below.

One embodiment provides a thermally fusible and steam-set capable spandex elastomeric yarn by solution spinning (dry-spinning or wet-spinning). The fiber includes a monofilament structure or a multiple filament structure. Each filament of the fiber (or the fiber itself for a monofilament) is a bicomponent fiber having discernable regions along the cross-section of the fiber such as a sheath-core configuration or a side-by-side configuration. The core is a first region and the sheath is a second region. Additional regions may be included to provide different cross-sections such as a side-by-side configuration in combination with a sheath-core, or a sheath-core with an additional sheath region.

For a fusible fiber, particularly useful compositions for the second region, which may be a sheath, may include:

A. a polymer blend where a first component includes a at least one polyurethane having a high melting point, such as polyurethanes having a melting point from about 190° C. to about 250° C., as well as those having a melting point of about 200° C. or higher and a fusibility improvement additive such as a low temperature melting polyurethane. Useful low melting point polyurethanes include those having a melting point from about 50° C. to about 150° C., especially those having a melting point below 120° C.; or B. a blend of where a first component includes at least one polyurethane having high melting point, such as polyurethanes having a melting point from about 190° C. to about 250° C., as well as those having a melting point of about 200° C. or higher and at least one adhesive material or fusibility improvement additive for subsequent substrate bonding where the adhesive material is a fusibility improvement additive; or C. a blend of at least one polyurethane, and at least one adhesive fusibility improvement additive.

Combinations and permutations of A, B, and C are also contemplated. Additional additives may also be included.

For a fusible fiber, particularly useful compositions for the first region, which may be a core, may include:

1) at least one polyurethane having a high melting point, such as polyurethanes having a melting point from about 190° C. to about 250° C., as well as those having a melting point of about 200° C. or higher; or 2) a blend of polyurethanes with a high melting point ranging from 200° C. to 250° C. and a polyurethane with low melting points below 180° C. or, 3) a blend of at least one polyurethane and at least one polyurethaneurea; or 4) a polyurethaneurea including those with a melting point greater than 240° C.

The bicomponent fibers of some embodiments can include a wide range of ratio of the first region to the second region. The second region, which can also be the sheath in a sheath-core configuration, can be present in an amount from about 1% to about 60% based on the weight of the fiber including from about 1% to about 50% by weight of the fiber, from about 10% to about 35% by weight of the fiber, and from about 5% to about 30% by weight of the fiber.

The fusible fibers of some embodiments can have a steam-set efficiency of greater than 50%. The fibers can also have a fusing strength of greater than 0.15 cN/dtex.

Some embodiments are multi-component, or bicomponent fibers including a solution-spun polymer composition including a polyurethane, a polyurethaneurea or a mixture thereof. The compositions for the different regions of the multi-component fibers include different polymer compositions in that the polymer is different, the additives are different, or both the polymer and additives are different. Multiple component fibers having a solution-spun portion and a melt-spun portion are also included.

Polyurethaneurea and Polyurethane Compositions

Polyurethaneurea compositions useful for preparing fiber or long chain synthetic polymers that include at least 85% by weight of a segmented polyurethane. Typically, these include a polymeric glycol which is reacted with a diisocyanate to form an NCO-terminated prepolymer (a "capped glycol"), which is then dissolved in a suitable solvent, such as dimethylacetamide, dimethylformamide, or N-methylpyrrolidone, and secondarily reacted with a difunctional chain extender. Polyurethanes are formed in a second step when the chain extenders are diols (and may be prepared without solvent). Polyurethaneureas, a sub-class of polyurethanes, are formed when the chain extenders are diamines. In the preparation of a polyurethaneurea polymer which can be spun into spandex, the glycols are extended by sequential reaction of the hydroxy end groups with diisocyanates and one or more diamines. In each case, the glycols must undergo chain extension to provide a polymer with the necessary properties, including viscosity. If desired, dibutyltin dilaurate, stannous octoate, mineral acids, tertiary amines such as triethylamine, N,N'-dimethylpiperazine, and the like, and other known catalysts can be used to assist in the capping step.

Suitable polymeric glycol components include polyether glycols, polycarbonate glycols, and polyester glycols of number average molecular weight of about 600 to about 3,500. Mixtures of two or more polymeric glycol or copolymers can be included.

Examples of polyether glycols that can be used include those glycols with two or more hydroxy groups, from ring-opening polymerization and/or copolymerization of ethylene oxide, propylene oxide, trimethylene oxide, tetrahydrofuran, and 3-methyltetrahydrofuran, or from condensation polymerization of a polyhydric alcohol, such as a diol or diol mixtures, with less than 12 carbon atoms in each molecule, such as ethylene glycol, 1,3-propanediol, 1,4-butanediol, 1,5-pentanediol 1,6-hexanediol, 2,2-dimethyl-1,3 propanediol, 3-methyl-1,5-pentanediol, 1,7-heptanediol, 1,8-octanediol, 1,9-nonanediol, 1,10-decanediol and 1,12-dodecanediol. A linear, bifunctional polyether polyol is preferred, and a poly(tetramethylene ether) glycol of molecular weight of about 1,700 to about 2,100, such as Terathane® 1800 (INVISTA of Wichita, Kans.) with a functionality of 2, is one example of a specific suitable glycols. Co-polymers can include poly(tetramethylene-co-ethyleneether) glycol.

Examples of polyester polyols that can be used include those ester glycols with two or more hydroxy groups, produced by condensation polymerization of aliphatic polycarboxylic acids and polyols, or their mixtures, of low molecular weights with no more than 12 carbon atoms in each molecule. Examples of suitable polycarboxylic acids are malonic acid, succinic acid, glutaric acid, adipic acid, pimelic acid, suberic acid, azelaic acid, sebacic acid, undecanedicarboxylic acid, and dodecanedicarboxylic acid. Examples of suitable polyols for preparing the polyester polyols are ethylene glycol, 1,3-propanediol, 1,4-butanediol, 1,5-pentanediol 1,6-hexanediol, neopentyl glycol, 3-methyl-1,5-pentanediol, 1,7-heptanediol, 1,8-octanediol, 1,9-nonanediol, 1,10-decanediol and 1,12-dodecanediol. A linear bifunctional polyester polyol with a melting temperature of about 5° C. to about 50° C. is an example of a specific polyester polyol.

Examples of polycarbonate polyols that can be used include those carbonate glycols with two or more hydroxy groups, produced by condensation polymerization of phosgene, chloroformic acid ester, dialkyl carbonate or diallyl carbonate and aliphatic polyols, or their mixtures, of low molecular weights with no more than 12 carbon atoms in each molecule. Examples of suitable polyols for preparing the polycarbonate polyols are diethylene glycol, 1,3-propanediol, 1,4-butanediol, 1,5-pentanediol, 1,6-hexanediol, neopentyl glycol, 3-methyl-1,5-pentanediol, 1,7-heptanediol, 1,8-octanediol, 1,9-nonanediol, 1,10-decanediol and 1,12-dodecanediol. A linear, bifunctional polycarbonate polyol with a melting temperature of about 5° C. to about 50° C. is an example of a specific polycarbonate polyol.

The diisocyanate component can also include a single diisocyanate or a mixture of different diisocyanates including an isomer mixture of diphenylmethane diisocyanate (MDI) containing 4,4'-methylene bis(phenyl isocyanate) and 2,4'-methylene bis(phenyl isocyanate). Any suitable aromatic or aliphatic diisocyanate can be included. Examples of diisocyanates that can be used include, but are not limited to, 4,4'-methylene bis(phenyl isocyanate), 2,4'-methylene bis (phenyl isocyanate), 4,4'-methylenebis(cyclohexyl isocyanate), 1,3-diisocyanato-4-methyl-benzene, 2,2'-toluenediisocyanate, 2,4'-toluenediisocyanate, and mixtures thereof. Examples of specific polyisocyanate components include Mondur® ML (Bayer), Lupranate® MI (BASF), and Isonate® 50 O,P' (Dow Chemical), and combinations thereof.

A chain extender may be either water or a diamine chain extender for a polyurethaneurea. Combinations of different chain extenders may be included depending on the desired properties of the polyurethaneurea and the resulting fiber. Examples of suitable diamine chain extenders include:

hydrazine; 1,2-ethylenediamine; 1,4-butanediamine; 1,2-butanediamine; 1,3-butanediamine; 1,3-diamino-2,2-dimethylbutane; 1,6-hexamethylenediamine; 1,12-dodecanediamine; 1,2-propanediamine; 1,3-propanediamine; 2-methyl-1,5-pentanediamine; 1-amino-3,3,5-trimethyl-5-aminomethylcyclohexane; 2,4-diamino-1-methylcyclohexane; N-methylamino-bis(3-propylamine); 1,2-cyclohexanediamine; 1,4-cyclohexanediamine; 4,4'-methylene-bis(cyclohexylamine); isophorone diamine; 2,2-dimethyl-1,3-propanediamine; meta-tetramethylxylenediamine; 1,3-diamino-4-methylcyclohexane; 1,3-cyclohexane-diamine; 1,1-methylene-bis(4,4'-diaminohexane); 3-aminomethyl-3,5,5-trimethylcyclohexane; 1,3-pentanediamine(1,3-diaminopentane); m-xylylene diamine; and Jeffamine® (Texaco).

When a polyurethane is desired, the chain extender is a diol. Examples of such diols that may be used include, but are not limited to, ethylene glycol, 1,3-propanediol, 1,2-propylene glycol, 3-methyl-1,5-pentanediol, 2,2-dimethyl-1,3-propanediol, 2,2,4-trimethyl-1,5-pentanediol, 2-methyl-2-ethyl-1,3-propanediol, 1,4-bis(hydroxyethoxy)benzene, and 1,4-butanediol, hexanediol and mixtures thereof.

A monofunctional alcohol or a primary/secondary monofunctional amine may optionally be included to control the molecular weight of the polymer. Blends of one or more monofunctional alcohols with one or more monofunctional amines may also be included.

Examples of monofunctional alcohols useful with the present invention include at least one member selected from the group consisting of aliphatic and cycloaliphatic primary and secondary alcohols with 1 to 18 carbons, phenol, substituted phenols, ethoxylated alkyl phenols and ethoxylated fatty alcohols with molecular weight less than about 750, including molecular weight less than 500, hydroxyamines, hydroxymethyl and hydroxyethyl substituted tertiary amines, hydroxymethyl and hydroxyethyl substituted heterocyclic compounds, and combinations thereof, including furfuryl alcohol, tetrahydrofurfuryl alcohol, N-(2-hydroxyethyl)succinimide, 4-(2-hydroxyethyl)morpholine, methanol, ethanol, butanol, neopentyl alcohol, hexanol, cyclohexanol, cyclohexanemethanol, benzyl alcohol, octanol, octadecanol, N,N-diethylhydroxylamine, 2-(diethylamino)ethanol, 2-dimethylaminoethanol, and 4-piperidineethanol, and combinations thereof.

Examples of suitable mono-functional dialkylamine blocking agents include: N,N-diethylamine, N-ethyl-N-propylamine, N,N-diisopropylamine, N-tert-butyl-N-methylamine, N-tert-butyl-N-benzylamine, N,N-dicyclohexylamine, N-ethyl-N-isopropylamine, N-tert-butyl-N-isopropylamine, N-isopropyl-N-cyclohexylamine, N-ethyl-N-cyclohexylamine, N,N-diethanolamine, and 2,2,6,6-tetramethylpiperidine.

Other Polymers

Other polymers that are useful with the multiple component and/or bicomponent fibers of the present invention include other polymers which are soluble or have limited solubility or can be included in particulate form (e.g., fin particulate). The polymers may be dispersed or dissolved in the polyurethane or polyurethaneurea solution or coextruded with the solution spun polyurethane or polyurethaneurea composition. The result of co-extrusion can be a bicomponent or multiple component fiber having a side-by-side, concentric sheath-core, or eccentric sheath-core cross-section where one component is polyurethaneurea solution and the other component contains another polymer. Examples of other polymers include low-melting polyurethanes (as described above), polyamides, acrylics, polyaramides, and polyolefins, among others. In some embodiments, a non-polyurethane polymer can be a fusibility improvement additive, especially where the polymer has a melting temperature below about 150° C.

Other polymers that can be included in the multiple component fibers include nylon 6, nylon 6/6, nylon 10, nylon 12, nylon 6/10, and nylon 6/12. Polyolefins include polyolefins prepared from $C_2$ to $C_{20}$ monomers. This includes copolymers and terpolymers such as ethylene-propylene copolymers. Examples of useful polyolefin copolymers are disclosed in U.S. Pat. No. 6,867,260 to Datta et al., incorporated herein by reference.

Fiber Cross-Section Configurations

A variety of different cross-sections are useful with the invention of some embodiments. These include bicomponent or multiple component concentric or eccentric sheath-core and bicomponent or multiple component side-by-side. Unique cross-sections are contemplated, so long as the cross-sections will include at least two separate regions. Alternative cross-sections may have a pie-slice configuration or similar to an eccentric sheath-core, where the sheath only partially surrounds the core. In other words, a second region of the cross section may partially or completely surround the first region. Examples of different suitable cross-sections are shown in FIG. 1.

A fusible polymer may be included as the majority or sole component of a sheath or side-by-side configuration or alternative configuration, without a separate fusibility improvement additive where the fusible polymer has the desired melting point.

All fiber cross-sections shown in FIG. 1 have a compositionally different first region and second region. A 44 dtex/3 filament yarn is shown in FIGS. 1A and 1B, while a 44 dtex/4 filament yarn is shown in FIGS. 1C and 1D. The first region in each includes a pigment and the second region does not. FIGS. 1A and 1B include a 50/50 sheath-core cross-section; FIG. 1C includes a 17/83 sheath-core cross-section; and FIG. 1D includes a 50/50 side-by-side cross-section.

Each of the sheath-core and side-by-side cross-sections includes a boundary area between at least two compositionally different polyurethaneurea compositions. The regions appear with a well-defined boundary in each of these figures, but the boundary may include a blended region. Where the boundary includes a blended region, the boundary itself is a distinct region which is a blend of the compositions of the first and second (or third, fourth, etc.) regions. This blend may be either a homogenous blend or may include a concentration gradient from the first region to the second region.

Additives

Classes of additives that may be optionally included in polyurethaneurea compositions are listed below. An exemplary and non-limiting list is included. However, additional additives are well-known in the art. Examples include: anti-oxidants, UV stabilizers, colorants, pigments, cross-linking agents, phase change materials (paraffin wax), antimicrobials, minerals (i.e., copper), microencapsulated additives (i.e., aloe vera, vitamin E gel, aloe vera, sea kelp, nicotine, caffeine, scents or aromas), nanoparticles (i.e., silica or carbon), calcium carbonate, flame retardants, anti-tack additives, chlorine degradation resistant additives, vitamins, medicines, fragrances, electrically conductive additives, dyeability and/or dye-assist agents (such as quaternary ammonium salts). Other additives which may be added to the polyurethaneurea compositions include adhesion promoters and fusibility improvement additives, anti-static agents, anti-creep agents, optical brighteners, coalescing agents, electroconductive additives, luminescent additives, lubricants, organic and inorganic fillers, preservatives, texturizing agents, thermochromic additives, insect repellants, and wetting agents, stabilizers (hindered phenols, zinc oxide, hindered amine), slip agents (silicone oil) and combinations thereof.

The additive may provide one or more beneficial properties including: dyeability, hydrophobicity (i.e., polytetrafluoroethylene (PTFE)), hydrophilicity (i.e., cellulose), friction control, chlorine resistance, degradation resistance (i.e., antioxidants), adhesiveness and/or fusibility (i.e., adhesives and adhesion promoters), flame retardance, antimicrobial behavior (silver, copper, ammonium salt), barrier, electrical conductivity (carbon black), tensile properties, color, luminescence, recyclability, biodegradability, fragrance, tack control (i.e., metal stearates), tactile properties, settability, thermal regulation (i.e., phase change materials), nutriceutical, delustrant such as titanium dioxide, stabilizers such as hydrotalcite, a mixture of huntite and hydromagnesite, UV screeners, and combinations thereof.

Additives may be included in any amount suitable to achieve the desired effect.

Several additives are useful as the fusibility improvement additive, having a low melting temperature, included in some embodiments. These include moisture-curing, thermobonding, and reactive hot-melt grades of linear, aromatic thermoplastic polyurethanes based on polyether, polyester, polycarbonate, and polycaprolactone, or blends thereof. Examples of specific commercially available, products include Mor-Melt (R-5022) (Rohm and Haas), Pellathane® 2103C (Dow), Desmopan® 5377, Desmopan 9375A, Texin DP7-1197 (Bayer Material Science), Pearlbond 104, 106, 122, 123 (Merquinsa Mercados Quimicos, S.L), and TPUA-252A (TPUCO, Taiwan), among others. The fusibility improvement additive may be included in any suitable amount to achieve the desired fusibility of the fiber. The fusibility improvement additive may be included in the sheath or second region of the fiber in an amount from about 10% to about 90% by weight of the sheath or second region, including from about 30% to about 60% by weight of the sheath or second region. The weight percent of the fusibility improvement additive based on the total weight of the multicomponent or bicomponent fibers will depend on the weight ratio of the core or first region to the sheath or second region of the fiber. In some cases the second sheath region may itself be a fusible polymer with or without the additional fusibility enhancing additives.

Apparatus

Bicomponent fibers have been typically prepared by a melt-spinning process. These apparatuses used for these processes can be adapted for use with a solution-spinning process. Dry-spinning and wet-spinning are solution-spinning processes that are well-known.

Convenient references relating to fibers and filaments, including those of man-made bicomponent fibers, and incorporated herein by reference, are, for example:

a. Fundamentals of Fibre Formation—The Science of Fibre Spinning and Drawing, Adrezij Ziabicki, John Wiley and Sons, London/New York, 1976;
b. Bicomponent Fibres, R Jeffries, Merrow Publishing Co. Ltd, 1971;
c. Handbook of Fiber Science and Technology, T. F. Cooke, CRC Press, 1993;

Similar references include U.S. Pat. Nos. 5,162,074 and 5,256,050 incorporated herein by reference, which describes methods and equipment for bicomponent fiber production.

Extrusion of the polymer through a die to form a fiber is done with conventional equipment such as, for example, extruders, gear pumps and the like. It is preferred to employ separate gear pumps to supply the polymer solutions to the die. When blending additives for functionality, the polymer blend is preferably mixed in a static mixer, for example, upstream of the gear pump in order to obtain a more uniform dispersion of the components. Preparatory to extrusion each spandex solution can be separately heated by a jacketed vessel with controlled temperature and filtered to improve spinning yield.

In the illustrated embodiment of the invention, two different polymer solutions are introduced to a segmented, jacketed heat exchanger operating at 40-90° C. The extrusion dies and plates are arranged according to the desired fiber configuration and illustrated in FIG. 2 for sheath-core, FIG. 3 eccentric sheath-core, and FIG. 4 side-by-side. In all cases the component streams are combined just above the capillary. Pre-heated solutions are directed from supply ports (2) and (5) through a screen (7) to a distribution plate (4) and on to the spinneret (9) which is position by a shim (8) and supported with a nut (6).

Figure 1A:
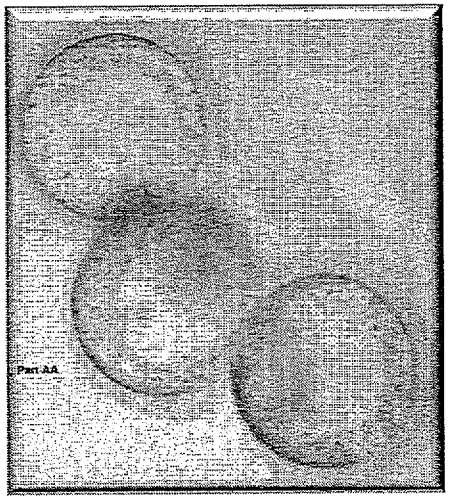
FIG. 1 shows examples of fiber cross-sections that can be achieved in some embodiments.
Figure 1B:
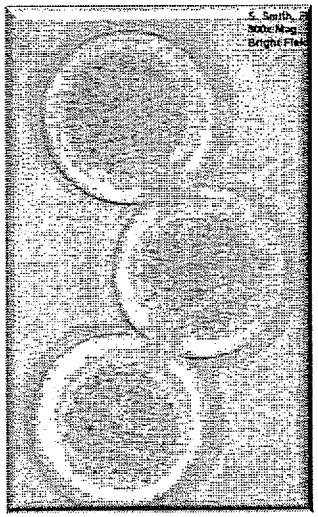
Figure 1C:
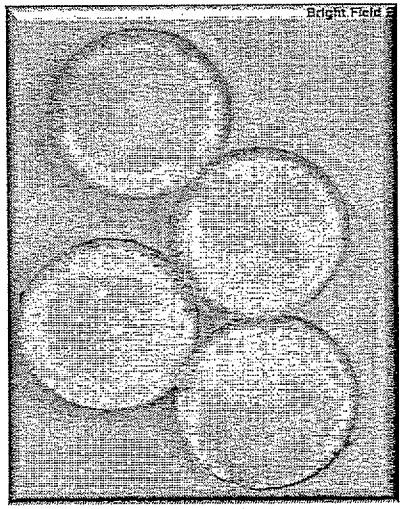
Figure 1D:
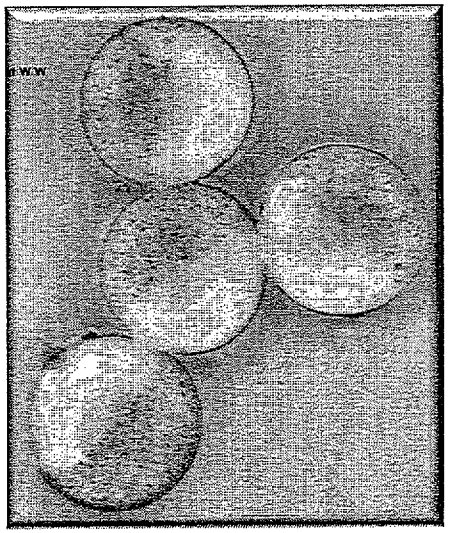
Figure 2:
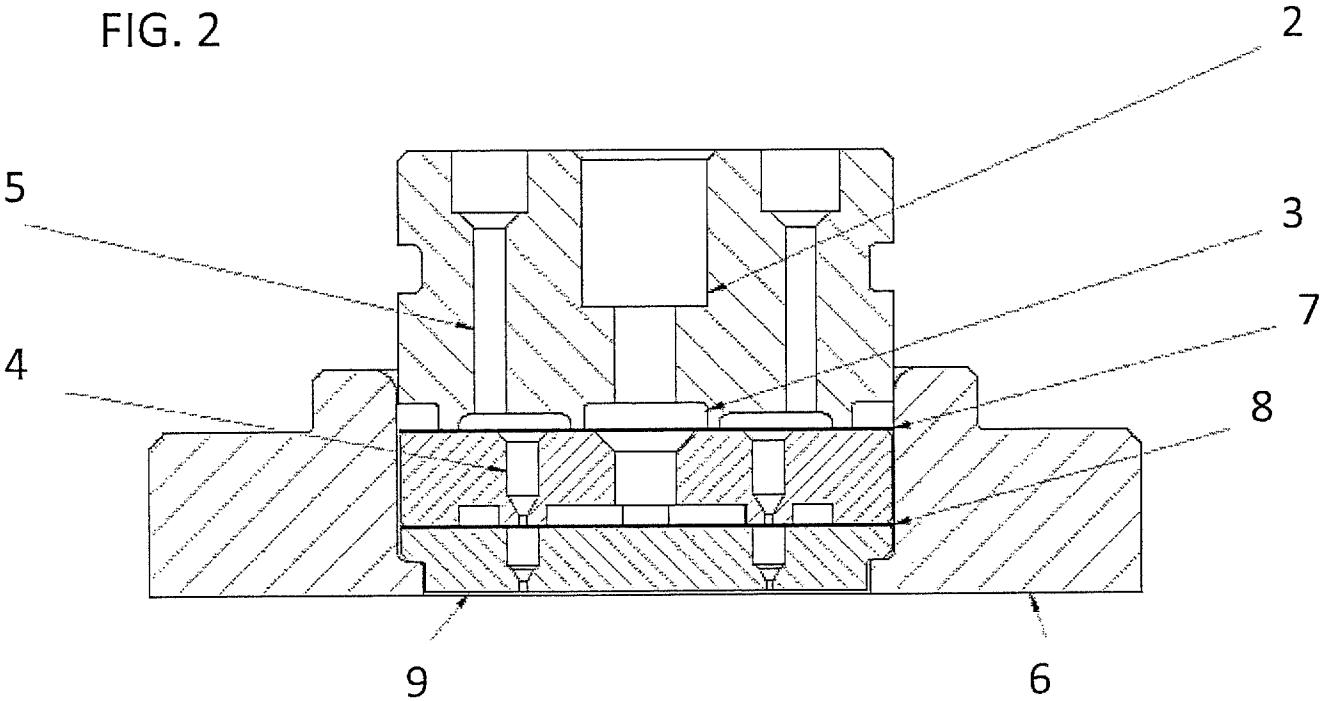
FIG. 2 is a schematic representation of a cross-section of a spinneret of some embodiments.
Figure 3:
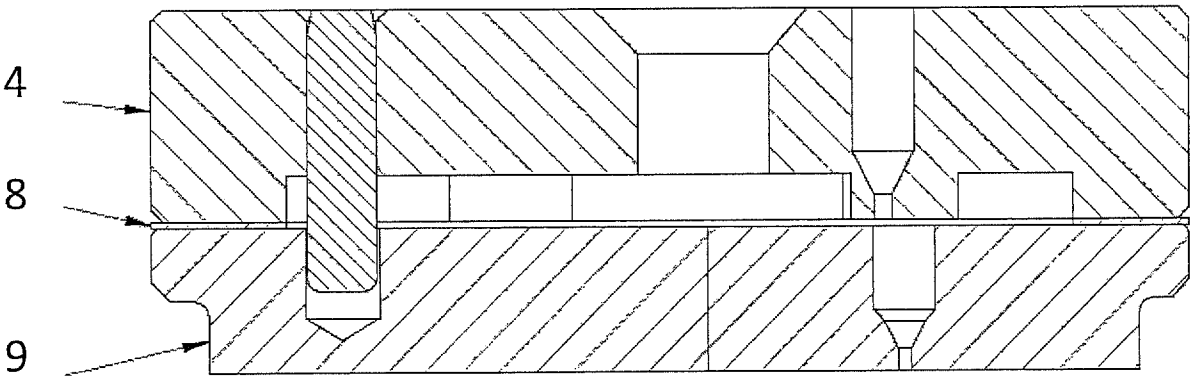
FIG. 3 is a schematic representation of a cross-section of a spinneret of some embodiments.
Figure 4:
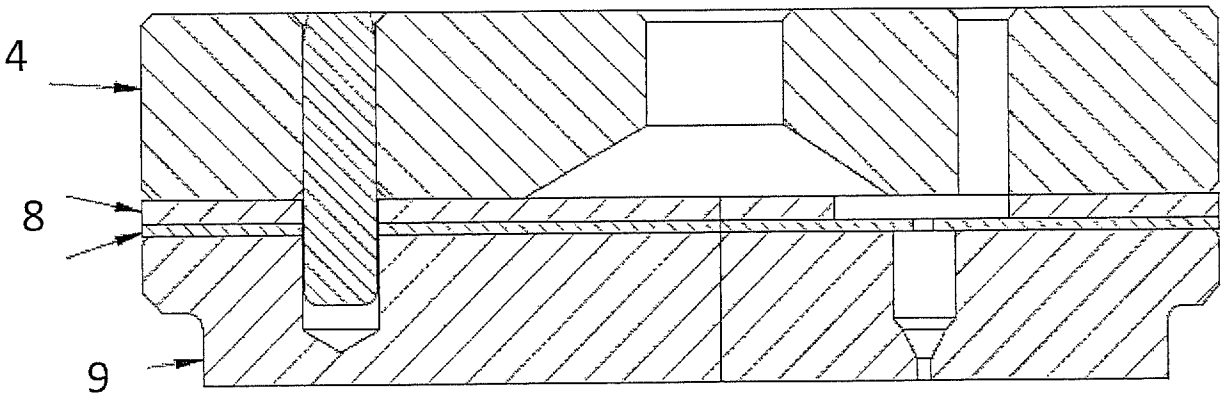
FIG. 4 is a schematic representation of a cross-section of a spinneret of some embodiments.

The extrusion dies and plates described in FIGS. 2, 3, and 4 are used with a conventional spandex spin cell such as that shown in U.S. Pat. No. 6,248,273, incorporated herein by reference.

The bicomponent spandex fibers may also be prepared by separate capillaries to form separate filaments which are subsequently coalesced to form a single fiber.

The features and advantages of the present invention are more fully shown by the following examples which are provided for purposes of illustration, and are not to be construed as limiting the invention in any way.

Process of Making Fibers

The fiber of some embodiments is produced by solution spinning (either wet or dry spinning) of the polyurethane or polyurethane-urea polymer from a solution with conventional urethane polymer solvents (e.g., DMAc). The polyurethane or polyurethaneurea polymer solutions may include any of the compositions or additives described above. The polyurethaneurea is prepared by reacting an organic diisocyanate with appropriate glycol, at a mole ratio of diisocyanate to glycol in the range of 1.6 to 2.3, preferably 1.8 to 2.0, to produce a "capped glycol". The capped glycol is then reacted with a mixture of diamine chain extenders. In the resultant polymer, the soft segments are the polyether/urethane parts of the polymer chain. These soft segments exhibit melting temperatures of lower than 60° C. The hard segments are the polyurethane/urea parts of the polymer chains; these have melting temperatures of higher than 200° C. The hard segments amount to 5.5 to 12%, preferably 6 to 10%, of the total weight of the polymer. A polyurethane polymer is prepared by reacting an organic diisocyanate with appropriate glycol, at a mole ratio of diisocyanate to glycol in the range of 2.2 to 3.3, preferably 2.5 to 2.95, to produce a "capped glycol". The capped glycol is then reacted with a mixture of diol chain extenders. The hard segments are the polyurethane segments of the polymer chains; these have melting temperatures ranging from 150-240° C. The hard segments can constitute 10 to 20%, preferably 13 to 7.5%, of the total weight of the polymer.

In one embodiment of preparing fibers, the polymer solutions containing 30-40% polymer solids are metered through desired arrangement of distribution plates and orifices to form filaments. Distribution plates are arranged to combine polymer streams in a one of concentric sheath-core, eccentric sheath-core, and side-by-side arrangement followed by extrusion thru a common capillary. Extruded filaments are dried by introduction of hot, inert gas at 300° C.-400° C. and a gas:polymer mass ratio of at least 10:1 and drawn at a speed of at least 400 meters per minute (preferably at least 600 m/min) and then wound up at a speed of at least 500 meters per minute (preferably at least 750 m/min). All examples given below were made with 80° C. extrusion temperature in to a hot inert gas atmosphere at a take-up speed of 762 m/min. Standard process conditions are well-known in the art.

Yarns formed from elastic fibers made in accordance with the present invention generally have a tenacity at break of at least 0.6 cN/dtex, a break elongation of at least 400%, an unload modulus at 300% elongation of at least 27 mg/dtex.

Yarns and fabrics can be prepared from the elastic multiple component fibers described herein by any conventional means. The elastic yarns can be covered with a second yarn, such as a hard yarn. Suitable hard yarns include nylon, acrylic, cotton, polyester and mixtures thereof, among others. Covered yarns can include single covered, double covered, air covered, corespun yarns and core twisted yarns.

The elastic yarns of some embodiments can be included in a variety of constructions such as knits (warp and weft), wovens, and nonwovens. These are useful in hosiery, leg wear, shirting, intimate apparel, swimwear, bottoms and nonwoven hygiene structures.

Where fusing or adhesion of the yarns is desired, this can be accomplished by exposure to heat and or static pressure up to 3.5 bar depending on the composition of the fusibility improvement additive. Heat can be applied as steam or dry heat. Suitable fusing conditions for hosiery can include exposure to temperatures from about 105° C. to about 135° C. for about 3 seconds to about 60 seconds, when steam heat is used, and 165° C. to about 195° C. for about 3 seconds to about 60 seconds, when dry heat is used. Suitable fusing conditions can vary depending on many factors including the selected fusibility improvement additive, polymer chemistry, yarn linear density, and fabric construction (i.e., knit, woven, etc.), among other factors.

For hosiery, fabrics are exposed to a variety of process conditions that include exposure to heat and/or pressure. Therefore, a separate heat-setting/fusing process is not required because the heat setting of the fabric will also result in fusing of the yarns including the fusibility improvement additive or other adhesive.

The strength and elastic properties of the spandex fibers in the examples were measured in accordance with the general method of ASTM D 2731-72. Three filaments, a 2-inch (5-cm) gauge length and a 0-300% elongation cycle were used for each of the measurements. The samples were cycled five times at a constant elongation rate of 50 centimeters per minute. Load power (M200) the stress on the spandex during initial extension, was measured on the first cycle at 200% extension and is reported as gram-force for a given denier. Unload power (U200) is the stress at an extension of 200% for the fifth unload cycle and is also reported in gram-force. Percent elongation at break and tenacity were measured on a sixth extension cycle. Percent set was also measured on samples that had been subjected to five 0-300% elongation/relaxation cycles. The percent set, % S, was then calculated as $$\% S=100(Lf-Lo)/Lo$$

where Lo and Lf are respectively the filament (yarn) length when held straight without tension before and after the five elongation/relaxation cycles.

To determine steam set, which simulates hosiery processing and boarding operations, a sample of a chosen length in the straight non-tensioned condition, Yo, (conveniently 10 cm) was stretched to three times its original length for about 2 minutes and then relaxed. This simulated a covering operation in which the spandex was drafted while being covered with a conventional yarn. The thusly stretched and relaxed spandex test sample was then placed in a boiling water bath for 30 minutes. This exposure to boiling water simulated a dyeing operation.

The sample was then removed from the bath, dried, and stretched to twice its post-bath relaxed length. While in this stretched condition, the sample was exposed for 30 seconds to an atmosphere of steam 121° C. This steam treatment simulates hosiery boarding. After removal from the steam atmosphere, the sample was allowed to dry, and its straight non-tensioned length, Yf, was measured. Steam set (SS,%) was then calculated according to the formula, $$\% SS=100(Yf-Yo)/Yo$$

Yarn fusibility was measured by mounting a 15 cm long sample on an adjustable frame in triangle shape with the vertex centered at the frame and two equal side lengths of 7.5 cm. A second filament of the same length is mounted on the frame from the opposite side such that the two yarns intersect and crossover with a single contact point.

Fibers are relaxed to 5 cm, then exposed to scouring bath for one hour, rinsed, air-dried, and subsequently exposed to a dye bath for 30 minutes, rinsed, and air-dried.

The frame with fibers is adjusted from 5 cm to 30 cm in length, and exposed to steam at 121° C. for 30 seconds, cooled for 3 minutes, and relaxed. Yarns are removed from the frame and transferred to tensile testing machine with each yarn clamped by one end leaving the contact point positioned between the clamps. Yarns are extended at 100%/min and the force to break (gram-force) the contact point is recorded as the fusing strength.

The features and advantages of the present invention are more fully shown by the following examples which are provided for purposes of illustration, and are not to be construed as limiting the invention in any way.

EXAMPLES

For Examples 1-3, below, the fibers were produced by dry-spinning of a high-melting polyurethane elastomeric polymer from a solution of N,N-dimethylacetamide (DMAc) CAS number 127-19-50. In order to provide adequate thermal stability to the final fiber, a high-melt polyurethane polymer was prepared as follows and was used as the basis for core and sheath compositions. A polyurethane prepolymer with a capping ratio of 2.70 was prepared by heating a mixture of MDI ((benzene, 1,1-methylenebis [isocyanato-] CAS number [26447-40-5]) and 2000 number average molecular weight PTMEG (poly(oxy-1,4-butanediyl), α-hydro-ω-hydroxy, CAS number 25190-06-1) to 75° C. for 2 hours. The pre-polymer was subsequently dissolved to a level of approximately 39% solids in DMAc. The prepolymer solution was extended at 75° C. by the addition of sufficient ethylene glycol (CAS number 107-21-1) to increase the 40° C. falling ball solution viscosity to 4000 poise. Once the solution reached aim viscosity, polymerization was terminated by adding a mono-functional alcohol (1-butanol (CAS number 71-36-3)).

The polymer solutions containing 35-40% polymer solids were metered through desired arrangement of distribution plates and orifices to form filaments. Distribution plates were arranged to combine polymer streams in a concentric sheath-core arrangement followed by extrusion thru a common capillary. Extruded filaments were dried by introduction of hot, inert gas at 320-440 C and a gas:polymer mass ratio of at least 10:1 and drawn at a speed of at least 400 meters per minute (preferably at least 600 m/min) and then wound up at a speed of at least 500 meters per minute (preferably at least 750 m/min). Yarns formed from these elastic fibers generally have a tenacity at break of at least 1 cN/dtex, a break elongation of at least 400%, an M200 of at least 0.2 cN/dtex.

Example 1

Figure 5:
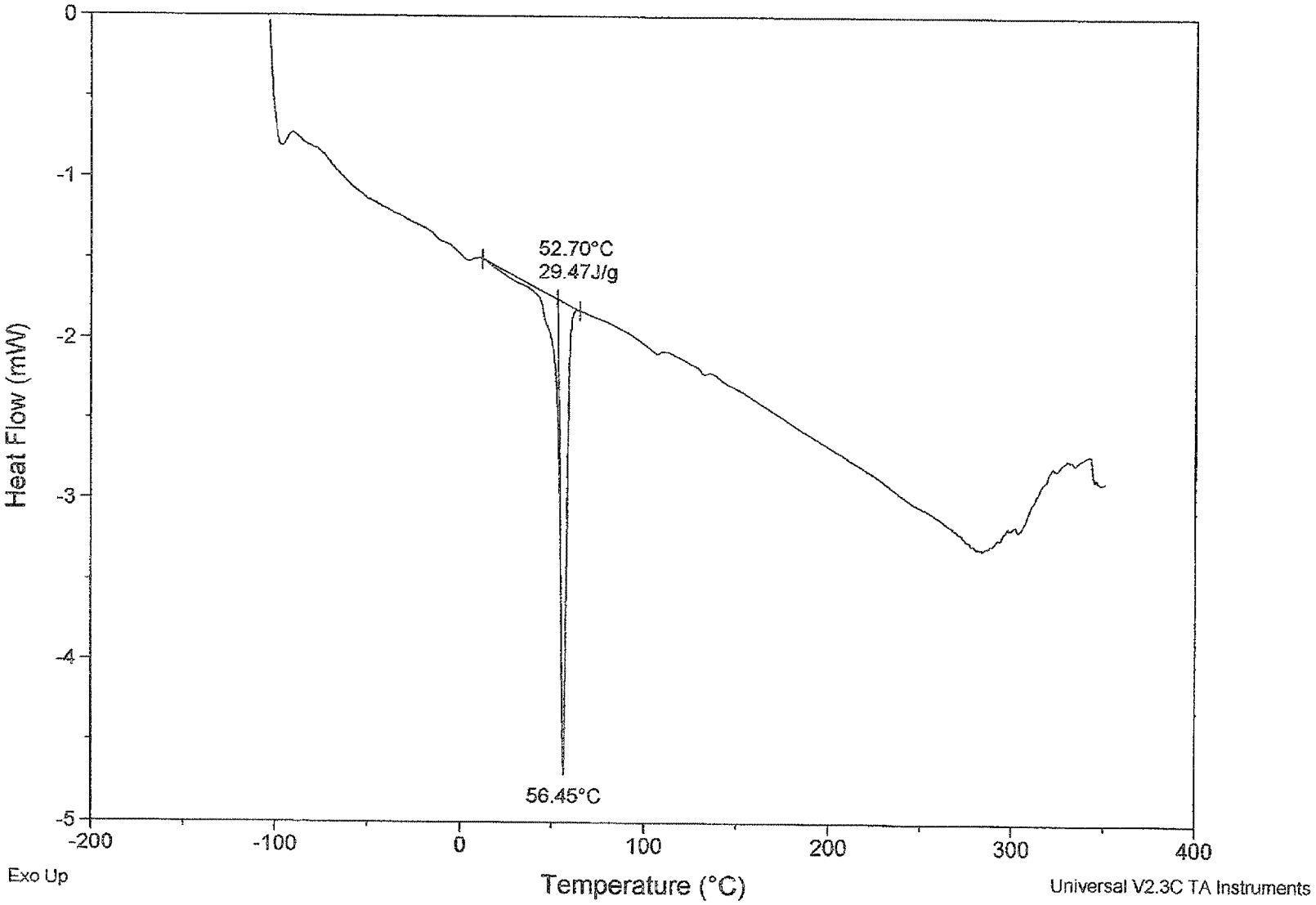
FIG. 5 is a depiction of the differential scanning calorimeter results for the fiber of Example 1.

A linear, poly-caprolactone based polyurethane, supplied by Merquinsa Mercados Quimicos, S.L (Pearlbond 122) was dissolved and blended at 30% weight ratio with the prepared high-melt PU polymer (described above) to form a 35% DMAc solution and extruded as the sheath component. The core solution consisted of high temperature PU polymer in DMAc and was combined with the sheath solution in a 4:1 ratio to form a 22 dtex two-filament yarn. Product was taken away at 700 m/min and wound on a package at 850 m/min after coating with silicone oil. Product properties including fusibility, steam-set efficiency, and tensile properties are given in Table 2. A differential scanning calorimeter trace (FIG. 5) illustrates a low melting transition at approximately 56° C. for the fusible additive.

Example 2

A thermoplastic polyurethane elastomer (Ester/Ether), supplied by Bayer Material Science, USA (Desmopan 5377A) was dissolved and blended at 60% weight ratio with the prepared high-temperature PU polymer (described above) to form a 36% DMAc solution and extruded as the sheath component. The core solution consisted of the high-melt PU polymer in DMAc and was combined with the sheath solution in a 4:1 ratio to form a 22 dtex two-filament yarn. Product was drawn away at 700 m/min and wound on a package at 850 m/min after coating with silicone oil. Product properties including fusibility, steam-set efficiency, and tensile properties are given in Table 2.

Example 3 (Comparative)

The prepared high-temperature PU polymer (described above), as a 39% DMAc solution, was extruded without modification as the sheath and core component as a 4:1 ratio to form a 22 dtex two-filament yarn. Product was drawn away at 700 m/min and wound on a package at 850 m/min after coating with silicone-based finish oil. Product properties including fusibility, steam-set efficiency, and tensile properties are given in Table 2.

Example yarns (from Examples 1-3) were covered with a flat 11 dtex/7 filament flat polyamide 66 yarn on a commercial Menegatto or ICBT covering machine. Draft ratio for the elastic yarn is 2.8× and the cover factor was 1500 tpm. Hosiery samples are knitted on a commercial knitting machine such as a Lonati 400 circular hosiery knitting machine. The covered yarn was knitted in an every course, tricot construction that allows fusing of the elastic yarn at each contact point of the knitted structure. Adequate fusing may also be achieved where the fusible yarn is included in alternate courses.

After standard operation of autoclaving and assembly, garments are set on standard boarding equipment in a steam chamber for 10-60 s at 110° C. and 130° C. Adequate fusibility is tested by mounting garments on an open board that will result in extensions typical during wear. A puncture is made by provoking a rupture of the elastic yarn with a knife or scissor. If the force of the elastic yarn, caused by the extension on the form, is lower than the force created by the fusion of the elastic yarn, this hole will not increase in size. If the force of the elastic yarn is higher, the fusing point will not stay intact, and the knitted structure will unravel (a so-called run or ladder). The laddering performance of the garments was observed visually and noted in Table 2. SEM analysis of the bond formation and fusing quality of the knitted hosiery (Example 1) is shown in FIG. 6 where the two-filament component 22 dtex yarn 10 has a point of fusing 11 and is surrounded by smaller filaments of nylon covering yarn 12.

TABLE 2

Fusible spandex filament properties

| Example | | 1 | 2 | 3 (comp.) |
|---|---|---|---|---|
| Elongation to Break | % | 414 | 383 | 420 |
| Teancity at Break | cN/dtex | 1.5 | 1.5 | 1.6 |
| M200 | cN/dtex | 0.20 | 0.31 | 0.25 |
| U200 | mN/dtex | 0.29 | 0.30 | 0.31 |
| Set | % | 26.1 | 28.7 | 27.1 |
| Residual DMAC | w/w % | 0.4 | 0.4 | 0.5 |
| Steam-set Efficiency | % | 69.4 | 66.8 | 57.0 |
| Fusing strength | gf | 3.9 | 2.1 | 0.8 |
| Laddering after puncture | | No | No | Yes |

Example 4

Fusible Sheath

A hot-melt crystalline thermoplastic polyurethane adhesive (Pearlbond 122 from Merquinsa Mercados Quimicos) was prepared as a 50/50 blend with conventional segmented polyurethaneurea as 35% solution in DMAc and spun as the sheath with a segmented polyurethaneurea convention spandex core to make a 44 decitex/3 filament yarn. Overall sheath content was 20% based on fiber weight to make a fusible yarn when heated above 80° C.

The advantage is a fiber with excellent fusing characteristics combined with superior stretch/recovery performance. Results of physical testing including steam-set and fusing strength are listed in Table 3.

TABLE 3

Segmented Polyurethaneurea fibers with Blended Sheath

| | |
|---|---|
| % Sheath (w/w) | 20% |
| % Adhesive (w/w) | 10% |
| Elongation % | 452 |
| Breaking force (g) | 39.8 |
| M200 (g) | 7.20 |
| U200 (g) | 0.93 |
| % SET | 43 |
| Fusing strength (g) | 10.2 |

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

What is claimed is:

1. A fiber comprising an elastic, multiple component fiber having discernable regions in a sheath-core configuration along a cross-section, said fiber spun from first and second polymer solutions , wherein at least a first region of said cross-section is the core spun from a first polymer solution comprising an elastomeric polyurethaneurea with a melting point greater than 240° C.; and including a second region said second region being the sheath spun from a second polymer solution comprising an elastomeric polyurethane, or a polyurethaneurea, or a mixture thereof with a melting point of 190-250° C. and at least one fusibility improvement additive, wherein said first and second regions have different compositions and are continuous along the fiber length; wherein said fusibility improvement additive includes at least one low temperature melting polyurethane with melting point less than 180° C.; and wherein said fiber exhibits a tenacity at break of at least 1 cN/dtex, a break elongation of at least 400%, an M200 of at least 0.2 cN/dtex and increased steam efficiency and fusing strength and decreased laddering after puncture as compared to a fiber prepared from a first polymer solution comprising an elastomeric polyurethaneurea with a melting point greater than 240° C.

2. The fiber of claim 1, wherein the fiber includes a monofilament structure or a multiple filament structure.

3. The fiber of claim 1, wherein said low temperature melting polyurethane has a melting point from about 50° C. to about 150° C.

4. The fiber of claim 1, wherein said low temperature melting polyurethane has a melting point below about 120° C.

5. The fiber of claim 1, wherein said second region is adjacent to or at least partially surrounds the first region.

6. The fiber of claim 5, wherein the second region comprises about 11% to about 60% by weight of the fiber.

7. The fiber of claim 5, wherein the second region comprises about 5% to about 30% by weight of the fiber.

8. The fiber of claim 1, wherein said elastic multiple component solution-spun fiber has a fusing strength greater than 0.15 cN/dtex.

9. A fabric comprising an elastic, multiple component, fiber having discernable regions in a sheath-core configuration along a cross-section, said fiber spun from first and second polymer solutions , wherein at least a first region of said cross-section is the core spun from a first polymer solution comprising an elastomeric polyurethaneurea with a melting point greater than 240° C.; and including a second region said second region being the sheath spun from a second polymer solution comprising an elastomeric polyurethane, or a polyurethaneurea, or a mixture thereof with a melting point of 190-250° C. and at least one fusibility improvement additive, wherein said first and second regions have different compositions and are continuous along the fiber length; wherein said fusibility improvement additive includes at least one low temperature melting polyurethane with melting point less than 180° C.; and wherein said fiber exhibits a tenacity at break of at least 1 cN/dtex, a break elongation of at least 400%, an M200 of at least 0.2 cN/dtex and increased steam efficiency and fusing strength and decreased laddering after puncture as compared to a fiber prepared from a first polymer solution comprising an elastomeric polyurethaneurea with a melting point greater than 240° C.

10. The fabric of claim 9, wherein said low temperature melting polyurethane fusibility improvement additive has a melting point from about 50° C. to about 150° C.

11. The fabric of claim 9, wherein said low temperature melting polyurethane fusibility improvement additive has a melting point below about 120° C.

12. The fabric of claim 9, wherein said second region is adjacent to or at least partially surrounds the first region.

13. The fabric of claim 9, wherein said elastic multiple component solution-spun fiber is covered.

14. The fabric of claim 13, wherein said elastic multiple component solution-spun fiber is covered with polyamide (nylon), cotton, polyester, or combinations thereof.

15. The fabric of claim 9, wherein said elastic multiple component solution-spun fiber is fusible.

16. The fabric of claim 9, wherein the fabric includes a knit, woven, or non-woven construction.

17. The fabric of claim 9, wherein said fabric comprises hosiery, leg wear, shirting, intimate apparel, swim wear, bottoms, and non-woven hygiene structures.

18. A process for preparing a the fusible, elastic, multiple component, solution-spun fiber of claim 1 comprising:(a) providing first and second polymer solutions;(b) combining the solutions through distribution plates and orifices to form filaments having a cross-section;(c) extruding the filaments through a common capillary; and(d) removing solvent from said filaments; wherein said cross-section includes a boundary between said polymer solutions; wherein each of said first and second polymer solutions independently includes an elastomeric polyurethane, a polyurethaneurea, or mixtures thereof; and wherein the second polymer solutions includes a fusibility improvement additive; wherein the fusible, elastic, multiple component, solution-spun fiber includes a multiple region cross-section with the first polymer solution corresponding to a first region of said cross-section and the second polymer solution corresponding to a second region of said cross-section.

* * * * *